US010738591B2

(12) United States Patent
Haubold et al.

(10) Patent No.: US 10,738,591 B2
(45) **Date of Patent: *Aug. 11, 2020**

(54) MULTI CHIP MODULE HOUSING MOUNTING IN MWD, LWD AND WIRELINE DOWNHOLE TOOL ASSEMBLIES

(71) Applicant: BAKER HUGHES INCORPORATED, Houston, TX (US)

(72) Inventors: Carsten Haubold, Celle (DE); Andreas Peter, Celle (DE); Michell Schimanski, Lower Saxony (DE); Christian Preiser, Wienhausen (DE)

(73) Assignee: Baker Hughes Holdings LLC, Houston, TX (US)

( * ) Notice: Subject to any disclaimer, the term of this patent is extended or adjusted under 35 U.S.C. 154(b) by 348 days.

This patent is subject to a terminal disclaimer.

(21) Appl. No.: 15/389,611

(22) Filed: Dec. 23, 2016

(65) Prior Publication Data

US 2017/0101864 A1 Apr. 13, 2017

Related U.S. Application Data

(63) Continuation of application No. 14/276,331, filed on May 13, 2014, now Pat. No. 9,546,546.

(51) Int. Cl.

| | |
|---|---|
| ***E21B 47/01*** | (2012.01) |
| ***E21B 36/00*** | (2006.01) |
| ***H05K 5/02*** | (2006.01) |

(52) U.S. Cl.

CPC ..... *E21B 47/011* (2013.01); *E21B 36/001* (2013.01); *E21B 36/003* (2013.01); *H05K 5/0213* (2013.01)

(58) Field of Classification Search

CPC ..... E21B 47/011

See application file for complete search history.

(56) References Cited

U.S. PATENT DOCUMENTS 3,746,106 A * 7/1973 McCullough ..... E21B 7/04 175/45

4,400,858 A 8/1983 Goiffon et al.

(Continued)

OTHER PUBLICATIONS

Coburn, M., et al. Drilling Tests of an Active Vibration Damper, SPE105400—SPE International, Drilling Conference held in Amsterdam, The Netherlands, Feb. 20-22, 2007.

*Primary Examiner* — Blake E Michener

(74) *Attorney, Agent, or Firm* — Mossman Kumar & Tyler PC

(57) ABSTRACT

An apparatus for protecting an electronics module used in a borehole includes a borehole string section having at least one pocket is formed and a mount associated with the at least one pocket. The mount may include a housing, a lid, a biasing member, and a securing member. The housing receives the electronics module and is seated on a seating surface, which may be formed on the at least one pocket or the mount. The lid encloses the housing within the at least one pocket. The biasing member is in operative contact with the housing. The securing member secures the lid within the at least one pocket and compresses the lid, the housing and the biasing member in the pocket. The biasing member responsively urges the housing against the seating surface and the housing hermetically seals the electronic module.

17 Claims, 2 Drawing Sheets

(56) References Cited

U.S. PATENT DOCUMENTS 4,610,299 A * 9/1986 Hoover ..... H01L 23/4006 165/185
4,788,467 A 11/1988 Plambeck
5,931,000 A * 8/1999 Turner ..... E21B 36/003 166/66
6,134,892 A * 10/2000 Turner ..... E21B 36/003 166/66
6,349,778 B1 * 2/2002 Blair ..... E21B 7/068 175/107
6,523,609 B1 * 2/2003 Miszewski ..... E21B 47/011 166/250.07
6,705,406 B2 3/2004 Das et al.
6,942,043 B2 * 9/2005 Kurkoski ..... E21B 47/01 175/40
7,178,608 B2 2/2007 Mayes et al.
7,363,971 B2 4/2008 Rodney et al.
7,980,331 B2 * 7/2011 Hall ..... E21B 41/0085 166/65.1
9,097,100 B2 * 8/2015 Finke ..... E21B 47/011
9,546,546 B2 * 1/2017 Haubold ..... E21B 47/011
10,012,036 B2 * 7/2018 Goodman ..... E21B 19/00
2005/0263668 A1 * 12/2005 Thigpen ..... F16F 7/08 248/560
2007/0023904 A1 2/2007 Salmon
2009/0126997 A1 * 5/2009 Webb ..... E21B 7/046 175/55
2010/0108306 A1 5/2010 Cooper
2010/0132434 A1 * 6/2010 Moake ..... E21B 47/01 73/1.82
2012/0228028 A1 9/2012 Turner et al.
2013/0087903 A1 4/2013 Cherchali et al.
2013/0105140 A1 5/2013 Barbara et al.
2013/0126171 A1 5/2013 Garnier et al.
2013/0168092 A1 7/2013 Evans
2013/0235537 A1 * 9/2013 Swett ..... E21B 47/011 361/752
2014/0185201 A1 * 7/2014 Barbara ..... H05K 5/066 361/679.01
2015/0275652 A1 * 10/2015 Fanini ..... E21B 47/01 166/381
2015/0337641 A1 * 11/2015 Mueller ..... E21B 47/011 166/66
2015/0337644 A1 * 11/2015 Mueller ..... E21B 47/01 166/242.1
2018/0179882 A1 * 6/2018 Treviranus ..... E21B 47/011

* cited by examiner

MULTI CHIP MODULE HOUSING MOUNTING IN MWD, LWD AND WIRELINE DOWNHOLE TOOL ASSEMBLIES

CROSS-REFERENCE TO RELATED APPLICATIONS

This application is a continuation of U.S. patent application Ser. No. 14/276,331, filed May 13, 2014, the disclosure of which is incorporated herein by reference in its entirety.

FIELD OF THE DISCLOSURE

This disclosure pertains generally to devices and methods for providing shock and vibration protection for borehole devices.

BACKGROUND OF THE DISCLOSURE

Exploration and production of hydrocarbons generally requires the use of various tools that are lowered into a borehole, such as drilling assemblies, measurement tools and production devices (e.g., fracturing tools). Electronic components may be disposed downhole for various purposes, such as control of downhole tools, communication with the surface and storage and analysis of data. Such electronic components typically include printed circuit boards (PCBs) that are packaged to provide protection from downhole conditions, including temperature, pressure, vibration and other thermo-mechanical stresses.

In one aspect, the present disclosure addresses the need for enhanced shock and vibration protection for electronic components and other shock and vibration sensitive devices used in a borehole.

SUMMARY OF THE DISCLOSURE

In aspects, the present disclosure provides an apparatus for protecting an electronics module used in a borehole. The apparatus may include a section of a borehole string having at least one pocket and a mount associated with the at least one pocket. The mount may include a housing, a lid, a biasing member, and a securing member. The housing receives the electronics module and is seated on a seating surface, which may be formed on the at least one pocket or the mount. The lid encloses the housing within the at least one pocket. The biasing member is in operative contact with the housing. The securing member secures the lid within the at least one pocket and compresses the lid, the housing and the biasing member in the pocket. The biasing member responsively urges the housing against the seating surface and the housing hermetically seals the electronic module.

In aspects, the present disclosure also provides a method for protecting a module used in a borehole. The method may include forming at least one pocket in a section of a borehole string; and disposing a mount at least partially into the at least one pocket. The mount may include a housing, a lid, a biasing member, and a securing member. The housing receives the electronics module and is seated on a seating surface, which may be formed on the at least one pocket or the mount. The method also includes enclosing the housing within the at least one pocket using a lid, operatively contacting the housing with a biasing member, securing the lid within the at least one pocket using a securing member, the securing member compressing the lid, the housing and the biasing member in the pocket, the biasing member responsively urging the housing against the seating surface; and hermetically sealing the electronic module using the housing.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Drilling conditions and dynamics produce sustained and intense shock and vibration events. These events can induce electronics failure, fatigue, and accelerated aging in the devices and components used in a drill string. In aspects, the present disclosure provides mountings and related methods for protecting these components from the energy associated with such shock events.

Figure 1:
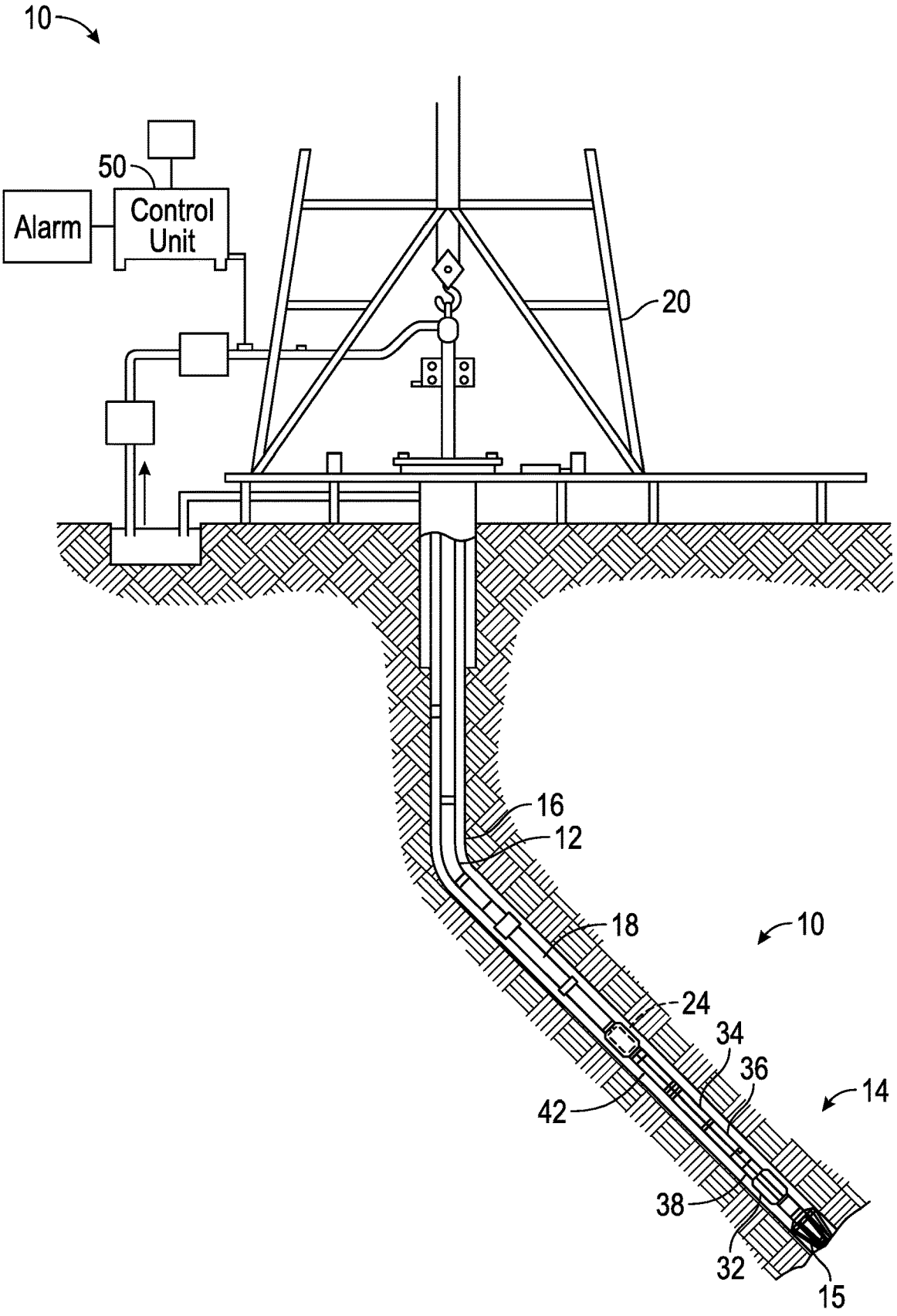
FIG. 1 shows a schematic of a well system that may use one or more mounts according to the present disclosure.

Referring now to FIG. 1, there is shown one illustrative embodiment of a drilling system 10 utilizing a borehole string 12 that may include a bottomhole assembly (BHA) 14 for directionally drilling a borehole 16. While a land-based rig is shown, these concepts and the methods are equally applicable to offshore drilling systems. The borehole string 12 may be suspended from a rig 20 and may include jointed tubulars or coiled tubing 18. In one configuration, the BHA 14 may include a drill bit 15, a sensor sub 32, a bidirectional communication and power module (BCPM) 34, a formation evaluation (FE) sub 36, and rotary power devices such as drilling motors 38. The sensor sub 32 may include sensors for measuring near-bit direction (e.g., BHA azimuth and inclination, BHA coordinates, etc.) and sensors and tools for making rotary directional surveys. The system may also include information processing devices such as a surface controller 50 and/or a downhole controller 42. Communication between the surface and the BHA 14 may use uplinks and/or downlinks generated by a mud-driven alternator, a mud pulser and/or conveyed using hard wires (e.g., electrical conductors, fiber optics), acoustic signals, EM or RF.

One or more electronics modules 24 incorporated into the BHA 14 or other component of the borehole string 12 may include components as necessary to provide for data storage and processing, communication and/or control of the BHA 14. These components may be disposed in suitable compartments formed in or on the borehole string 12. Exemplary electronics in the electronics module include printed circuit board assemblies (PCBA) and multiple chip modules (MCM's).

Figure 2:
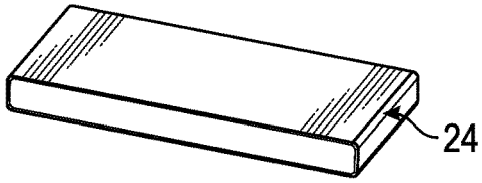
FIG. 2 illustrates one embodiment of an electronics module that may be protected using a mount according to the present disclosure.

Referring to FIG. 2, there is shown one non-limiting embodiment of a module 24 that may be used with the borehole string 12 of FIG. 1. The module 24 can be a BHA's tool instrument module, which can be a crystal pressure or temperature detection, or frequency source, a sensor acoustic, gyro, accelerometer, magnetometer, etc., sensitive mechanical assembly, MEM, multichip module MCM, Printed circuit board assembly PCBA, flexible PCB Assembly, Hybrid PCBA mount, MCM with laminate substrate MCM-L, multichip module with ceramic substrate e.g. LCC or HCC, compact Integrated Circuit IC stacked assemblies with ball grid arrays or copper pile interconnect technology, etc. All these types of modules 24 often are made with fragile and brittle components which cannot take bending and torsion forces and therefore benefit from the protection of the package housing and layered protection described below.

Exemplary mounts for protecting shock and vibration sensitive equipment such as the electronics module 24 are described below. Although the embodiments described herein are discussed in the context of electronics modules, the embodiments may be used in conjunction with any component that would benefit from a structure having high damping, high thermal conduction, and/or low fatigue stress. Furthermore, although embodiments herein are described in the context of downhole tools, components and applications, the embodiments are not so limited.

Figure 3:
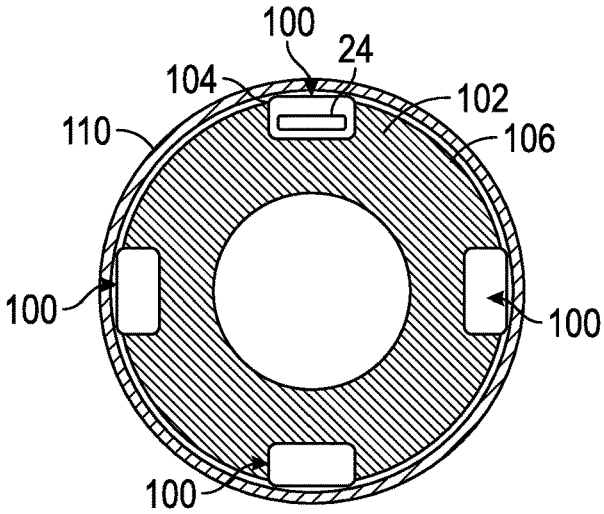
FIG. 3 illustrates an end view of a section of a BHA that has a plurality of electronics protected by mounts according to one embodiment of the present disclosure.

FIG. 3 schematically illustrates a mount 100 for protecting a module 24 (FIG. 2) from shock and vibration. The mount 100 may be formed in a section 102 of the borehole string 12 of FIG. 1. For example, the section 102 may be a drill collar, a sub, a portion of a jointed pipe, or the BHA 14. The mount 100 may be secured within a pocket 104 formed on an outer circumferential surface 106 of the section 102. A sleeve 110 surrounds the section 102 secures the mounts 100 within the pockets 104. The sleeve 110 may be formed of a non-magnetic material such as stainless steel. While four mounts 100 are shown circumferentially distributed on the section 102, it should be understood that greater or fewer number of mounts 100 may be used. In embodiments, one common continuous sleeve 110 secures a plurality of circumferentially distributed mounts 100.

Figure 4:
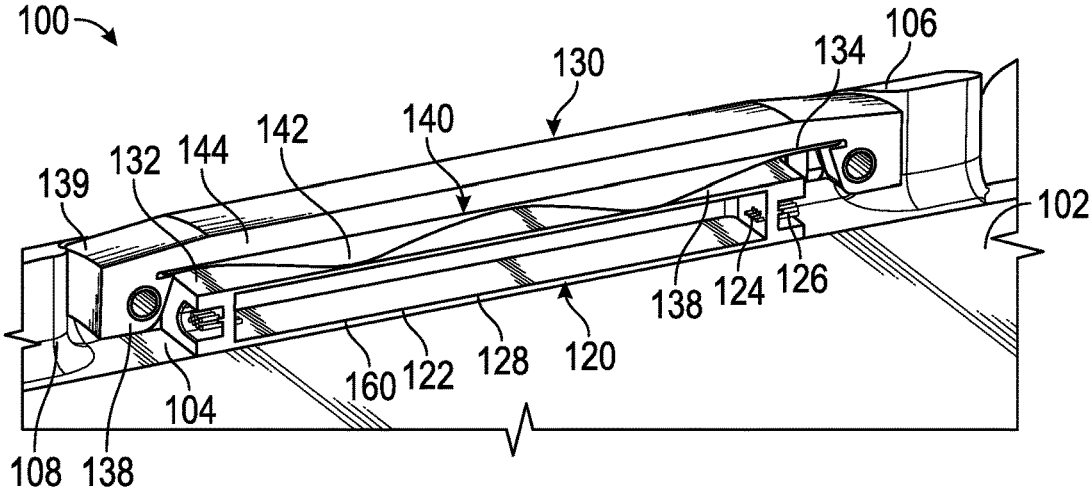
FIG. 4 illustrates a sectional view of a section of the BHA that includes a mount according to one embodiment of the present disclosure.

FIG. 4 sectionally illustrates one embodiment of a mount 100 that may be used to resiliently secure the module 24 (FIG. 2) within the pocket 104. The pocket 104 may be pre-formed or machined (e.g., milled) into the section 102 and include passages 108 for wiring and other equipment that connect to the module 24 (FIG. 2). The passages 108 may connect the pocket 104 with other compartments, chambers, or cavities that contain electrical equipment such as sensors (not shown). The mount 100 may include a housing 120, a lid 130, and a biasing member 140.

The housing 120 provides a hermetically sealed environment for the module 24 (FIG. 2). The housing 120 may include a sealed casing 122 formed of a metal such as titanium or Kovar. These types of metals have a thermal expansion similar to the ceramic, glass, composite, or other material used to encase the module 24 (FIG. 2). Electrical connections to the module 24 may be made using the internal connectors 124 and the external connectors 126. It should be understood that the shown configuration for the housing 120 is merely one non-limiting example of a housing 120 that may be used in connection with mounts 100 according to the present disclosure.

Figure 5:
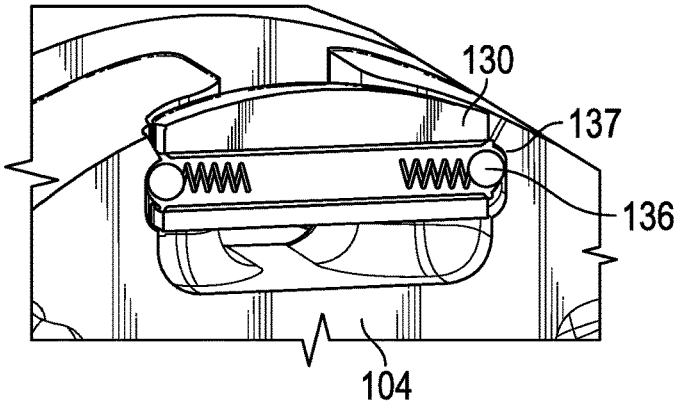
FIG. 5 illustrates a latching arrangement that may be used with a mount according to one embodiment of the present disclosure.

The lid 130 encloses the housing 120 within the pocket 104. The lid 130 may include a recess 132 for receiving the biasing element 140 and the housing 120. The recess 132 may include a shoulder 134 or other similar feature that contacts the housing 120 to minimize movement in the axial direction. As used herein, the term axial refers to a longitudinal directional along the borehole string 12 (FIG. 1). Referring to FIG. 5, the lid 130 may optionally include latches 136 that secure the lid 130 within the pocket 104. The latches 136 may be positioned at an end 138 of the lid 30 and include spring-biased balls or other locking mechanisms engage a suitable profile 137 formed in the pocket 104. The lid 130 may be formed of a suitable non-magnetic material such as stainless steel. Additionally, the lid 130 may include a ramped or sloped portions 139 that allow the sleeve 110 to slide over the lid 130 during final installation.

The biasing member 140 applies a spring force that presses the housing 120 against a seating surface 128 of the pocket 104. The biasing member 140 may be any structure that has range of elastic deformation sufficient to generate a persistent spring force. As shown, the biasing member 140 may be a leaf spring that has one or more apex regions 142 that compressively contact the housing 120. While the apex regions 142 are shown in a medial section of the biasing member 140, it should be understood that the apex regions 142 may distributed throughout the biasing member 140. For instance, apex regions 142 may be located at a distal end 144 of the biasing member 120. Other springs such as coil springs or spring washers, may be used. Additionally, pressurized fluids may be used to generate a spring force. Also, while point contacts are shown, it should be understood that the biasing member 140 may be formed as a body such as a pad that distributes compressive force of a relatively large surface area. The biasing member 140 may be retained in a suitable groove or slot in the recess 132.

Some embodiments may include a heat transfer pad 160 positioned between the housing 120 and the seating surface 128. One non-limiting embodiment of a heat transfer pad 160 may be formed at least partially of a visco-elastic material. As used herein, a viscoelastic material is a material having both viscous and elastic characteristics when undergoing deformation. More generally, the heat transfer pad 160 may be formed of any material that transfers heat from the housing 120 to the section 102 and/or provides shock absorption.

It should be understood that the mounts according to the present disclosure are susceptible to numerous variants. For example, circumferential springs may be used to fix the mounts inside the pocket.

Referring not to FIGS. 1-5, in one mode of use, each module 24 is first inserted into a housing 120. The internal electrical connections 124 are made up and the housing 120 is hermetically sealed. Next, the housing 120 is disposed into the pocket 104 and wires (not shown) are connected to the external electrical connections 126. The lid 130 and biasing member 140 are then set over the housing 120. Depressing the lid 130 allows the latching members 136 to snap the lid 130 into place in the pocket 104. After all the modules 24 are installed, the sleeve 110 is slid over the pockets 104. The sleeve 110 interferingly engages the lid 130 because an inner surface of the sleeve 110 is more radially inward that an outer surface of the lid 130 when the lid 130 rests on a relaxed biasing member 140. This interfering engagement forces the lid 130 move radially inward, which compresses the biasing member 140. In response to being compressed, the biasing member 140 presses the housing 120 against the heat transfer pad 160. Thus, the module 24 is restrained against lateral motion; i.e., motion transverse to the longitudinal axis of the tool. Additionally, the shoulder 134 of the lid 130 and frictional forces at the heat transfer pad 160 minimize movement of the housing 130 in the axial direction or sliding motion generally.

During drilling or other activities in the borehole 16, the section 102 may encounter shocks and vibrations. Advantageously, the mount 100 minimizes movement of the housing 120 and enclosed module 24 in the lateral and axial directions when subjected to these movements. Also, the heat transfer pad 160 conducts heat from the housing 120 to a suitable heat sink, such as a drilling mud flowing in the borehole string 12.

While the foregoing disclosure is directed to the one mode embodiments of the disclosure, various modifications will be apparent to those skilled in the art. It is intended that all variations be embraced by the foregoing disclosure.

We claim:

1. An apparatus for protecting an electronics module used in a borehole, comprising:

a section of a borehole string having at least one pocket;

a mount associated with the at least one pocket, wherein the mount includes:

a housing receiving the electronics module, the housing being seated on a seating surface, the seating surface being formed on one of: (i) the at least one pocket, and (ii) the mount, a lid enclosing the housing within the at least one pocket, and a biasing member in operative contact with the housing; and a securing member securing the lid within the at least one pocket and compressing the lid, the housing and the biasing member in the pocket, the biasing member responsively urging the housing against the seating surface, wherein the biasing member is positioned radially between the lid and the housing.

2. The apparatus according to claim 1, further comprising a heat transfer pad positioned between the housing and the seating surface.

3. The apparatus according to claim 2, wherein the heat transfer pad is formed of a viscoelastic material.

4. The apparatus of claim 1, wherein the section of the borehole string is one of: (i) a drill collar, (ii) a sub, and (iii) a bottomhole assembly.

5. The apparatus of claim 1, wherein the at least one pocket includes at least one passage connecting the at least one pocket to a compartment in the borehole string.

6. The apparatus of claim 1, wherein the securing member interferingly engages the lid.

7. The apparatus of claim 1, wherein the borehole string is configured to drill the borehole.

8. The apparatus of claim 1, wherein the housing hermetically seals the electronic module and the electronics module is a multichip module comprising a ceramic substrate.

9. A method for protecting an electronics module used in a borehole, comprising:

forming at least one pocket in a section of a borehole string;

disposing a mount at least partially into the at least one pocket, wherein the mount includes a housing receiving the electronics module, the housing being seated on a seating surface, the seating surface being formed in one of: (i) the at least one pocket, and (ii) the mount;

enclosing the housing within the at least one pocket using a lid;

operatively contacting the housing with a biasing member; and securing the lid within the at least one pocket using a securing member, the securing member compressing the lid, the housing and the biasing member in the pocket, the biasing member responsively urging the housing against the seating surface, wherein the biasing member is positioned radially between the lid and the housing.

10. The method according to claim 9, further comprising positioning a heat transfer pad between the housing and the seating surface.

11. The method according to claim 9, wherein the heat transfer pad is formed of a viscoelastic material.

12. The method of claim 9, wherein the section of the borehole string is one of: (i) a drill collar, (ii) a sub, and (iii) a bottomhole assembly.

13. The method of claim 9, wherein the at least one pocket includes at least one passage connecting the at least one pocket to a compartment in the borehole string.

14. The method of claim 9, wherein the securing member interferingly engages the lid.

15. The method of claim 9, wherein the borehole string is configured to drill the borehole.

16. The method of claim 9, further comprising hermetically sealing the electronic module using the housing and the electronics module is a multichip module comprising a ceramic substrate.

17. An apparatus for protecting an electronics module used in a borehole, comprising:

a section of a borehole string having at least one pocket;

a mount associated with the at least one pocket, wherein the mount includes:

a housing receiving the electronics module, the housing being seated on a seating surface, the seating surface being formed on one of: (i) the at least one pocket, and (ii) the mount, a lid enclosing the housing within the at least one pocket, and a biasing member in operative contact with the housing; and a securing member securing the lid within the at least one pocket and compressing the lid, the housing and the biasing member in the pocket, the biasing member responsively urging the housing against the seating surface, wherein the biasing member is positioned between the lid and the housing receiving the electronics module and not between the housing and the seating surface.

* * * * *